US008034528B2

(12) United States Patent
Liu et al.

(10) Patent No.: US 8,034,528 B2
(45) Date of Patent: Oct. 11, 2011

(54) HYBRID CHEMICALLY-PRODUCED TONERS

(75) Inventors: Yongning Liu, Apex, NC (US); Eric Dumain, Hillsborough, NC (US)

(73) Assignee: Reichhold, Inc., Research Triangle Park, NC (US)

( * ) Notice: Subject to any disclaimer, the term of this patent is extended or adjusted under 35 U.S.C. 154(b) by 941 days.

(21) Appl. No.: 11/937,675

(22) Filed: Nov. 9, 2007

(65) Prior Publication Data

US 2008/0118857 A1 May 22, 2008

Related U.S. Application Data

(60) Provisional application No. 60/866,894, filed on Nov. 22, 2006.

(51) Int. Cl.
*G03G 5/00* (2006.01)

(52) U.S. Cl. ..... 430/137.15; 430/109.2; 430/109.3; 430/109.4

(58) Field of Classification Search ..... 430/137.15, 430/109.2, 109.3, 109.4
See application file for complete search history.

(56) References Cited

U.S. PATENT DOCUMENTS

| | | | | |
|---|---|---|---|---|
| 2002/0098431 | A1 | 7/2002 | Fujikawa et al. | |
| 2004/0161688 | A1 * | 8/2004 | Itakura et al. | 430/108.4 |

FOREIGN PATENT DOCUMENTS

| | | | |
|---|---|---|---|
| EP | 0 462 785 | A2 | 12/1991 |
| EP | 0 573 705 | A1 | 12/1993 |
| EP | 0 658 818 | A1 | 6/1995 |
| EP | 1 437 629 | A2 | 7/2004 |
| JP | 2001 175029 | A | 6/2001 |

OTHER PUBLICATIONS

Search Report and Written Opinion, PCT/US2007/023723, mailed May 21, 2008.

* cited by examiner

*Primary Examiner* — Mark Chapman
(74) *Attorney, Agent, or Firm* — Myers Bigel Sibley & Sajovec PA

(57) ABSTRACT

Provided according to some embodiments of the present invention are hybrid chemically-produced toners produced by a method including forming a resin component including a) at least one of a water reducible acrylic resin and a water dispersible polyester resin; and b) an epoxy; subjecting the resin component to conditions sufficient to form a hybrid resin component; and dispersing the hybrid resin component into water.

9 Claims, No Drawings

HYBRID CHEMICALLY-PRODUCED TONERS

CROSS-REFERENCE TO RELATED APPLICATIONS

This application claims the benefit of U.S. Provisional Patent Application No. 60/866,894, filed Nov. 22, 2006, the disclosure of which is herein incorporated by reference in its entirety.

FIELD OF THE INVENTION

The present invention relates to toners for use in electrophotographic processes, and more particularly, to chemically-produced toners for use in electrophotographic processes.

BACKGROUND OF THE INVENTION

In typical dry-type electrophotographic processes, latent electrostatic images formed on a photoconductor are developed by means of a triboelectrically charged toner. Specifically, when an image is formed by a photographic copying machine, a surface of a roller composed of a photoconductive and photosensitive material is charged. An electrostatic latent image is formed by exposure to the light reflected from the surface of an original to be copied. The latent image is developed by a toner, with the formed visible image being transferred to a paper or the like. The transferred image is fixed on the paper by compression under heating, and thus a copy print is obtained.

A typical toner includes several components including a toner resin, a colorant and an electrostatic carrier material. Traditionally, toner resins have been made by compounding and melting the toner components (resin, colorant, etc.), followed by extruding the mixture into strands or pellets. These solid masses are then pulverized into small particles and sorted to provide the desired particle size and particle size distribution. While this method has been widely used, it has several limitations. For example, forming toner particles having a size less than about 8 micron is not economically feasible using conventional techniques. In addition, the shape of the toner particles may be undesirably non-uniform, which may affect toner properties, such as charge-to-mass ratio. Furthermore, narrow particle size distributions may be difficult to achieve. Other problems include the energy intensive pulverizing process and the inability to tailor the microstructure of the toner particles.

The disadvantages associated with conventional methods of producing toner have led to the so-called "chemically-produced toner" or CPT. As opposed to the "large-to-small" approach of conventional toner processes, CPT processes use a "small-to-large" approach, using polymerization techniques to form the basic toner particle structure. While there are many different types of CPT, typical polymerization techniques include suspension polymerization, emulsion polymerization and aggregation, microencapsulation, dispersion and condensation polymerization. These techniques can produce toner particles in a 3 to 5 micron size or less range, and may produce narrower particle size distributions than typically obtained from conventional processes. In addition, relatively uniform toner particle shape may be achieved and particle composition may be more precisely controlled. Examples of CPT include the toner resins discussed in U.S. Pat. No. 3,634,251, which describes CPT synthesized by a suspension polymerization process; and the toner resins discussed in U.S. Pat. No. 4,027,048, which describes a CPT microencapsulation process.

One disadvantage with current methods for producing CPT is that they require an emulsifier/surfactant. This may be problematic because a small amount of residual surfactant may undesirably affect the properties of the toner particles, including the tribocharge, and the removal of all of the surfactant from the particles may be difficult to achieve. Furthermore, these processes also often require a chain transfer agent, such as dodecanthiol, to control molecular weight. Residual chain transfer agent may also undesirably affect the toner properties.

Therefore, it would be desirable to obtain CPT that is not synthesized using a surfactant and/or a chain transfer agent. Such toner resins should ideally have desirable pigment dispersion, heat resistance and chargeability, as well as relatively low fusing temperatures.

SUMMARY OF THE INVENTION

Provided according to some embodiments of the present invention are hybrid chemically-produced toners produced by a method including forming a resin component including a) at least one of a water reducible acrylic resin and a water dispersible polyester resin; and b) an epoxy; subjecting the resin component to conditions sufficient to form a hybrid resin component; and dispersing the hybrid resin component into water. In some embodiments, the epoxy is a solid epoxy resin and/or a glycidyl (meth)acrylate/acrylic acid copolymer (GMA acrylic).

In some embodiments of the present invention, the resin component further includes a pigment component and a wax component.

In some embodiments of the present invention, subjecting the resin component to conditions sufficient to form a hybrid resin component includes heating the resin component at a temperature of in a range of about 88 to about 92° C. for a time in a range of about 4 to about 5 hours. In some embodiments of the invention, subjecting the resin component to conditions sufficient to form a hybrid resin component further includes mixing the resin component at a high shear rate.

In some embodiments of the invention, the water reducible acrylic resin, if present, is present as an aqueous solution; the polyester resin, if present, is present as an aqueous dispersion; and the epoxy is present as an alcoholic solution. In some embodiments of the invention, methods further include heating the hybrid resin component dispersed in water in order to remove the alcohol.

In some embodiments of the invention, the chemically-produced toner may have a particle size distribution of less than about 4. In some embodiments of the present invention, the hybrid chemically-produced toners may have a particle size distribution of less than about 4, a glass transition temperature in a range of about 45° C. to about 120° C. and/or a $T_{1/2}$ in a range of about 90° C. to about 190° C.

DETAILED DESCRIPTION OF EMBODIMENTS OF THE INVENTION

The invention is described more fully hereinafter. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein:

The term "chemically-produced toner" refers to a toner that includes toner particles that are produced via polymerization techniques. Chemically-produced toner particles are not formed via the pulverization/breakage of larger polymeric masses. Chemically-produced toner may also be referred to as chemical toner or polymerized toner.

The term "water reducible acrylic" refers to any water soluble resin that is derived from an acrylic acid monomer.

The term "polyester resin" refers to any polymer resin that includes an ester repeating unit, such as polymers formed by the reaction of a dibasic acid with a dihydric alcohol.

The term "epoxy" refers to a polymer that includes epoxy functional groups.

The term "pigment" refers to any colorant that is added to the toner in an amount sufficient to provide color to the toner resin, and thus includes compounds such as dyes.

In some embodiments of the present invention, provided are hybrid chemically-produced toners produced by a method including forming a resin component, subjecting the resin component to conditions sufficient to form a hybrid resin component, and dispersing the hybrid resin component into water.

In some embodiments, the resin component includes a) at least one of a water reducible acrylic resin and a polyester resin; and b) an epoxy.

Any suitable water reducible acrylic resin may be used, including mixtures of different water reducible resins. Commercially available water reducible acrylics include, but are not limited to, Johnson Polymer Joncryl® ECO 675; Rohm & Haas MoreZ® 101; and Johnson Polymer's Joncryl® 142. In some embodiments of the invention, the water reducible acrylic may have an acid value in a range of about 100 to about 225. In some embodiments of the invention, the water reducible acrylic may have a glass transition temperature in a range of about 30 to about 120° C. In some embodiments of the invention, the water reducible acrylic resin may be present as an aqueous solution, for example, an aqueous solution having 25-40% non-volatiles (% NV).

Any suitable polyester resin may be used, including mixtures of different polyester resins. Exemplary commercially available polyester resins include, but are not limited to, Fine-Clad® M-8761 (Reichhold). In some embodiments of the invention, the polyester resin has an acid value in a range of about 70 to about 150. In some embodiments of the invention, the polyester resin may be present as an aqueous dispersion, for example, an aqueous dispersion having 25-40% NV.

Any suitable epoxy may be used, including mixtures of different epoxy resins. Exemplary epoxies include solid epoxy resins such as Dow's DER™ 667E, 668-20, 669-20, 6155, and the like, glycidyl methacrylates, glycidyl methacrylate/acrylic acid copolymers ("GMA acrylic"), glycidyl acrylate/acrylic acid copolymers, glycidyl methacrylate/styrene copolymer and Novalac epoxies. The epoxy resin is typically present as an alcoholic solution, such as an alcoholic solution having 60-75% NV. Exemplary alcoholic solutions include n-butanol, butyl cellosolve, and mixtures thereof.

The hybrid resin component refers to the resulting solution produced by the physical and/or chemical integration of all components included in the resin component.

The term "shear rate" refers to the rate at which adjacent layers of fluid move with respect to each other. A high shear rate, as used herein, refers to a shear rate sufficient to mix the aqueous and solvent components and allow for the reaction between the acid functionalities in the aqueous phase and the epoxy functionalities in the solvent phase, e.g., about 100 RPM to 200 RPM.

In some embodiments of the present invention, the resin component includes other toner components, such as a pigment, wax, rheology modifiers, and other suitable additives that are known to one of skill in the art.

Any suitable pigments may be used. For example, pigments that may be used according to some embodiments of the invention include, but are not limited to, black colorants, such as carbon black, a magnetic material, or a colorant that appears black by the mixture of yellow, magenta and cyan colorants; yellow colorants, such as condensed azo compounds, isoindolinone compounds, anthraquinone compounds, azo metal complexes, methin compounds and arylamide compounds; magenta colorants, such as condensed azo compounds, diketopyrrole compounds, anthraquinone compounds, quinacridone compounds, basic dye lake compounds, napthol compounds, benzimidizole compounds, thioindigo compounds and perylene compounds; and cyan colorants, such as copper phthalocyanine compounds and their derivatives, anthraquinone compounds and basic dye lake compounds.

Any suitable wax may be used. Suitable waxes are known to one of skill in the art, but exemplary waxes may include low-molecular weight hydrocarbon waxes, such as petroleum waxes, low-molecular weight polyolefin waxes and polymethylene waxes; long chain alcohol waxes; and ester waxes, such as carnauba wax-purified wax and a candelilla wax-purified wax. An exemplary commercially available wax is Licowax (Clariant).

In some embodiments of the present invention, the procedure for forming the hybrid chemically-produced toner includes the following steps. A water reducible acrylic resin in an aqueous solution and/or a polyester resin in an aqueous dispersion is added to an epoxy resin in an alcoholic solution. A pigment (e.g., carbon black) and wax (e.g., polyethylene wax) are added to the mixture. The resin mixture is then heated under a nitrogen atmosphere with stirring (e.g., at about 88° C. to about 92° C. for about 4-5 hours). The stirring rate of the mixture is increased to a high speed (e.g., 100 to 200 RPM) and deionized water is added dropwise (e.g., over 30 minutes). The temperature is then increased, for example, to a temperature of about 95-100° C., and the alcoholic solvent is stripped. The temperature necessary to strip the alcohol may vary according to the alcohol used. The temperature is then reduced and the resulting polymer particles are collected and dried. A charge control agent is then added to the dried sample and the sample is agitated.

In some embodiments of the present invention, the hybrid chemically-produced toner particles have an average particle size in a range of about 0.1 microns and 5 microns. In some embodiments, the average particle size is in a range of about 0.1 microns and 3 microns, and in some embodiments, in a range of about 0.05 microns and about 1 or 2 microns. In some embodiments of the invention, the particle size distribution may be less than about 8, in some embodiments, less than about 4, and in some embodiments, less than about 2.

In addition, in some embodiments, the hybrid chemically-produced toner of the invention may have desirable heat resistance and chargeability. In some embodiments, the toner resin particles may have a glass transition temperature in a range of about 45° C. to about 120° C., in some embodiments in a range of about 45° C. to about 100° C., and in some embodiments in a range of about 50° C. to about 120° C. In some embodiments, the toner resin particles may have a $T_{1/2}$ in a range of about 90° C. to about 190° C., in some embodiments in a range of about 90° C. to about 150° C., and in some embodiments in a range of about 120° C. to about 190° C.

Thus, toner resin particles including pigment, wax and other additives, may be produced without the use of surfactants, emulsifiers, stabilizers or chain transfer agents. In addition, toner resin particles of suitable size and uniformity may be produced, and a hybrid chemically-produced toner having desirable properties may be provided.

The present invention will now be described in more detail with reference to the following examples, However, these examples are given for the purpose of illustration and are not to be construed as limiting the scope of the invention.

EXAMPLES

Resin Examples

Example 1

In a 1 liter four-neck glass flask equipped with a thermometer, stainless steel stirrer, nitrogen inlet and reflux condenser were placed 70 g of synthesized water reducible acrylic (NV=30%, acid value: 188 in solid, $T_g$=62° C.) and 90 g of epoxy resin (commercial available solid epoxy resin with EEW=2,000, cut in n-butanol, NV 70%). The acrylic/epoxy weight ratio in the solid=25/75. With the flask heated in a mantle heater, the reactants were heated at 88-92° C. for 4 hours with stirring under normal pressure in a nitrogen atmosphere. Increasing agitation speed to high, 300 g of DI water was added, dropwise over 30 minutes, and the temperature dropped to 65-70° C. The flask was heated to 95-97° C. in order to strip the solvent (isotrope of n-butanol/water). The temperature was reduced to 50° C. and 100 g of the sample was collected in a container, while the rest of the sample was placed in a tray and dried at 50° C. overnight. The dried sample had a DSC $T_g$: 83° C.; acid value: 25; GPC molecular weight of $M_n$: 1,559, $M_v$: 6,2211 and molecular weight distribution of $M_w/M_n$: 4; Shimadzu $T_s$: 104° C., $T_{fb}$: 116° C., $T_{1/2}$: 149° C., and $T_{end}$: 170° C.; and AREA DMA storage modulus G' @200° C.: 394,320 Pa. The wet sample had an average particle size (PS) of 0.79 micron and a particle size distribution (PSD) of 3.9.

Examples 2-5

Using the same water reducible acrylic and epoxy resin as in Example 1, the acrylic/epoxy weight ratios were varied in Examples 2-5. The data is summarized in Table 1.

TABLE 1

| | Example 2 | Example 3 | Example 4 | Example 5 |
|---|---|---|---|---|
| Acrylic/Epoxy Wt. Ratio | 35/65 | 50/50 | 65/35 | 75/25 |
| $T_g$ (° C.) | 72 | 59 | 54 | 51 |
| Acid Value | 27 | 53 | 85 | 110 |
| PS (Micron) | 0.92 | 1.77 | 1.29 | 2.44 |
| PSD | 3.5 | 3.5 | 3.9 | 5.4 |
| $M_n$ | 1,327 | 1,652 | 1,907 | 1,190 |
| $M_w$ | 7,324 | 10,547 | 15,737 | 14,703 |
| $M_w/M_n$ | 6 | 6 | 8 | 12 |
| $T_s$ (° C.) | 96 | 79 | 71 | 73 |
| $T_{fb}$ (° C.) | 114 | 100 | 94 | 93 |
| $T_{1/2}$ (° C.) | 145 | 128 | 121 | 119 |
| $T_{end}$ (° C.) | 169 | 137 | 130 | 127 |
| G' @ 200° C. (Pa) | 386,700 | 64,249 | 14,999 | 9,736 |

Examples 6-10

While the water reducible acrylic resin (the same as used in Example 1) and the weight ratio of acrylic/epoxy in solid (35/65) was fixed, the EEW of the epoxy resin as varied in Examples 6-10. The data is summarized in Table 2.

TABLE 2

| | Example 6 | Example 7 | Example 8 | Example 9 | Example 10 |
|---|---|---|---|---|---|
| Epoxy Resins (EEW) | 4100 | 2400 | 1635 | 1359 | 926 |
| Tg (° C) | 73 | 79 | 76 | gelled | gelled |
| Acid Value | 55 | 36 | 42 | NA | NA |
| PS (micron) | 1.87 | 1.12 | 1.49 | NA | NA |
| PSD | 8.4 | 5.0 | 2.3 | NA | NA |
| $M_n$ | 2,640 | 1,946 | 1,258 | NA | NA |
| $M_w$ | 14,441 | 8,917 | 5,464 | NA | NA |
| $M_w/M_n$ | 5.5 | 4.6 | 4.3 | NA | NA |
| $T_s$ (° C.) | 95 | 93 | 85 | NA | NA |
| $T_{fb}$ (° C.) | 117 | 113 | 110 | NA | NA |
| $T_{1/2}$ (° C.) | 142 | 141 | 147 | NA | NA |
| $T_{end}$ (° C.) | 150 | 151 | 175 | NA | NA |
| G' @ 200° C. (Pa) | 24,280 | 192,000 | 1,089,000 | NA | NA |

Examples 11-15

The epoxy resin (same as the epoxy resin used in Example 1) and the acrylic/epoxy weight ratio in solid (35/65) were fixed, while the water reducible acrylics used was varied in Examples 11-15. The data is summarized in Table 3.

TABLE 3

| | Example 11 | Example 12 | Example 13 | Example 14 | Example 15 |
|---|---|---|---|---|---|
| Acrylic Resins | ECO 675 | MoreZ 101 | Synthesized | Joncryl 142 | Synthesized |
| $T_g$ (° C.) | 114 | 110 | 82 | 78 | 109 |
| Acid Value | 16 | 34 | 25 | 24 | 59 |
| PS (Micron) | 1.15 | 0.13 | 0.24 | 0.45 | 1.06 |
| PSD | 1.58 | 1.98 | 7.5 | 2.58 | 10.6 |
| $M_n$ | 2,640 | 2,898 | 1,948 | 4,709 | 1,508 |
| $M_w$ | 14,414 | 10,303 | 7,841 | 17,788 | 10,583 |
| Mw/Mn | 4 | 4 | 4 | 4 | 7 |
| $T_s$ (° C.) | 120 | 126 | 106 | 83 | 87 |
| $T_{fb}$ (° C.) | 162 | 144 | 112 | 115 | 101 |
| $T_{1/2}$ (° C.) | 190 | 178 | 138 | 147 | 128 |
| $T_{end}$ (° C.) | 209 | 185 | 146 | 160 | 137 |
| G' @ 200° C. (Pa) | 40,322 | 4,735 | 22,037 | 68,491 | 13,498 |

Example 11: Johnson Polymer's ECO 675: $T_g$ = 103° C., NV = 32%, acid value: 222 in solid.
Example 12: Rohm & Haas's MoreZ 101: $T_g$ = 93° C., NV = 33%, acid value: 205 in solid.
Example 13: synthesized acrylic: $T_g$ = 73° C., NV = 30%, acid value: 100 in solid.
Example 14: Johnson Polymer's Joncryl 142: $T_g$ = 32° C., NV = 40%, acid value: 150 in solid.
Example 15: synthesized acrylic: $T_g$ = 36° C., NV = 29%, acid value: 161 in solid.

Example 16

A procedure analogous to that described in Example 1 was used, wherein GMA acrylic (EEW=2000 in solid resin, NV=67% in n-Butanol) was used as the epoxy resin, and the same water reducible acrylic as in Example 1 was used, and the weight ratio of the water reducible acrylic/GMA acrylic=25/75 in solid. The dried sample had a DSC $T_g$: 53° C.; acid value: 35; GPC molecular weight of $M_n$: 1,528, $M_w$: 7,539 and molecular weight distribution of $M_w/M_n$: 4.9; Shimadzu $T_s$: 78° C., $T_{fb}$: 101° C., $T_{1/2}$: 137° C. and $T_{end}$: 155° C.; and AREA DMA storage modulus G' @200° C.: 228,200 Pa. The wet sample had an average particle size of 4.52 microns and particle size distribution of 1.1.

Example 17

GMA acrylic (EEW=2000 in solid resin, NV=67% in n-Butanol) was used as the epoxy resin in Example 1, the same water reducible acrylic as in Example 1 was used and the weight ratio of the water reducible acrylic/GMA acrylic=50/50 in solid. The dried sample had a DSC $T_g$: 53° C. and 84° C. (double Tg); acid value: 68; GPC molecular weight of $M_n$: 3,705, $M_w$: 18,826, and molecular weight distribution of $M_w/M_n$: 5.1; Shimadzu $T_s$: 86° C., $T_{fb}$: 104° C., $T_{1/2}$: 130° C. and $T_{end}$: 138° C.; and AREA DMA storage modulus G' @200° C.: 25,770 Pa. The wet sample had an average particle size of 3.09 microns and particle size distribution of 1.6.

Example 18

86 g of an aqueous polyester dispersion (acid value: 70 in solid resin, NV: 31%, $T_g$ of the solid resin: 59° C.) and 70 g of an epoxy resin (commercially available solid epoxy resin with EEW=2,000, cut in n-butanol, NV=70%) were used in this Example using the same procedure as described with reference to Example 1. The dried sample had a DSC $T_g$: 73° C.; acid value: 21; GPC molecular weight of $M_n$: 3,350, $M_w$: 8,024 and molecular weight distribution of $M_w/M_n$: 2.4; Shimadzu $T_{fb}$: 76° C., $T_{1/2}$: 87° C., and $T_{end}$: 109° C. The wet sample had an average particle size of 0.58 micron and a particle size distribution of 1.2.

Example 19

100 g of an aqueous polyester dispersion (acid value: 130 in solid resin, NV: 31.5%, $T_g$ of the solid resin: 50° C.) and 45 g of an epoxy resin (commercially available solid epoxy resin with EEW=2,000, cut in n-butanol, NV=70%) were used in this Example using the same procedure as described with reference to Example 1. The dried sample had DSC $T_g$: 64° C.; acid value: 33; GPC molecular weight of $M_n$: 1,835, $M_w$: 10,164 and molecular weight distribution of $M_w/M_n$: 5.5; Shimadzu $T_s$: 78° C., $T_{fb}$: 90° C., $T_{1/2}$: 115° C., and $T_{end}$: 122° C. The wet sample had an average particle size of 0.66 micron and particle size distribution of 1.2.

Toner Examples

Example 20

In a 1 liter four-neck glass flask equipped with a thermometer, stainless steel stirrer, nitrogen inlet and reflux condenser were placed 150 g of synthesized water reducible acrylic (NV=30%, acid value: 188 in solid, $T_g$=62° C.), 120 g of epoxy resin (commercially available solid epoxy resin with EEW=2,000, cut in n-butanol, NV=70%; acrylic/epoxy weight ratio in solid was 35/65), 6.45 g of carbon black and 3.87 g of polyethylene wax (Licowax F). With the flask heated in a mantle heater, the reactants were heated at 88-92° C. for 4 hours with stirring under normal pressure in a nitrogen atmosphere. Increasing the agitation speed to high, 400 g of DI water was added dropwise over 30 minutes, and the temperature dropped to 65-70° C. The flask was heated to 95-97° C. in order to strip the solvent (isotrope of n-butanol/water). Reducing temperature to 50° C., about 100 g of the sample was collected in a container and the rest of the sample was placed in a tray and dried at 50° C. overnight. 1.29 g of charge control agent (N4P) was added to the dried sample and the mixture was shaken for 30 minutes. The dried sample had charge per mass (Q/M): 4.9 μC/g; Shimadzu $T_s$: 94° C., $T_{fb}$: 119° C., $T_{1/2}$: 150° C., and $T_{end}$: 173° C.; AREA DMA storage modulus G' @200° C.: 153,000 Pa. The wet sample had an average particle size of 1.19 microns and a particle size distribution of 2.95.

Example 21

In a 1 liter four-neck glass flask equipped with a thermometer, stainless steel stirrer, nitrogen inlet and reflux condenser were placed 190 g of synthesized water reducible acrylic (NV=30%, acid value: 188 in solid, $T_g$=62° C.), 85 g of GMA acrylic (EEW=2000 in solid resin, NV=67% in n-Butanol), 5.7 g of carbon black, and 3.42 g of polyethylene wax (Licowax F). With the flask heated in a mantle heater, the reactants were heated at 88-92° C. for 4 hours with stirring under normal pressure in a nitrogen atmosphere. Increasing the agitation speed to high. 300 g of DI water was added dropwise over 30 minutes, and the temperature dropped to 65-70° C. The flask was heated to 95-97° C. to strip the solvent (isotrope of n-butanol/water). Reducing the temperature to 50° C., about 100 g of the sample was collected in a container and the rest of the sample was placed in a tray and dried at 50° C. overnight. 1.14 g charge control agent (N4P) was added to the dried sample and the mixture was shaken for 30 minutes. The dried sample had a charge per mass (Q/M): 5.1 μC/g; Shimadzu $T_s$: 77° C., $T_{fb}$: 102° C., $T_{1/2}$: 127° C., and $T_{end}$: 135° C.; and AREA DMA storage modulus G' @200° C.: 15,347 Pa. The wet sample had an average particle size of 2.83 microns and a particle size distribution of 5.64.

Although selected embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A hybrid chemically-produced toner produced by a method comprising forming a resin component comprising a) at least one of a water reducible acrylic resin and a water dispersible polyester resin; and b) an epoxy;

chemically integrating the at least one of a water reducible acrylic resin and a water dispersible polyester resin and the epoxy to form a hybrid resin component; and dispersing the hybrid resin component into water to form a hybrid chemically-produced toner resin, wherein the forming of the resin component and the chemically integrating the at least one of a water reducible acrylic resin and a water dispersible polyester resin and the epoxy are performed without the use of surfactants, emulsifiers, stabilizers or chain transfer agents.

2. The hybrid chemically-produced toner of claim 1, wherein the resin component further comprises a pigment component and a wax component.

3. The hybrid chemically-produced toner of claim 1, wherein the chemically integrating the at least one of a water reducible acrylic resin and a water dispersible polyester resin and the epoxy comprises heating the resin component at a temperature of in a range of about 88 to about 92° C. for a time in a range of about 4 to about 5 hours.

4. The hybrid chemically-produced toner of claim 3, wherein the chemically integrating the at least one of a water reducible acrylic resin and a water dispersible polyester resin and the epoxy further comprises mixing the resin component at a high shear rate.

5. The hybrid chemically-produced toner of claim 1 having a particle size distribution of less than about 4.

6. The hybrid chemically-produced toner of claim 1, wherein the epoxy is a solid epoxy resin and/or a glycidyl (meth)acrylate/acrylic acid copolymer (GMA acrylic).

7. The hybrid chemically-produced toner of claim 1, wherein the water reducible acrylic resin, if present, is present as an aqueous solution; the polyester resin, if present, is present as an aqueous dispersion; and the epoxy is present as an alcoholic solution.

8. The hybrid chemically-produced toner of claim 7, wherein the method further comprises heating the hybrid resin component dispersed in water in order to remove the alcohol.

9. The hybrid chemically-produced toner of claim 1 having a glass transition temperature in a range of about 45° C. to about 120° C. and a $T_{1/2}$ in a range of about 90° C. to about 190° C.

* * * * *

UNITED STATES PATENT AND TRADEMARK OFFICE

CERTIFICATE OF CORRECTION

PATENT NO. : 8,034,528 B2
APPLICATION NO. : 11/937675
DATED : October 11, 2011
INVENTOR(S) : Liu et al.

It is certified that error appears in the above-identified patent and that said Letters Patent is hereby corrected as shown below:

Column 6, Line 12: Please correct "$M_v$" to read -- $M_w$ --

Signed and Sealed this
Twenty-seventh Day of December, 2011

David J. Kappos

David J. Kappos
*Director of the United States Patent and Trademark Office*